United States Patent [19]

Granieri

[11] Patent Number: 4,697,398

[45] Date of Patent: Oct. 6, 1987

[54] MULTISTORIED ASEISMIC BUILDING MADE OF MODULAR PANELS

[76] Inventor: Luigi Granieri, SS 3 bis, 05060 Pantalla (PG), Italy

[21] Appl. No.: 826,928

[22] Filed: Feb. 7, 1986

[30] Foreign Application Priority Data

Nov. 25, 1985 [IT] Italy ..... 48822 A/85

[51] Int. Cl.[4] ..... E04C 3/22

[52] U.S. Cl. ..... 52/236.8; 52/259; 52/470

[58] Field of Search ..... 52/79.11, 79.13, 259, 52/250, 251, 252, 439, 432, 227, 583, 236.8, 470, 586

[56] References Cited

U.S. PATENT DOCUMENTS

| | | | |
|---|---|---|---|
| 1,924,801 | 8/1933 | Olmsted | 52/236.8 |
| 3,350,828 | 11/1967 | Russell | 52/285 |
| 3,621,626 | 11/1971 | Tylius | 52/227 |
| 3,685,241 | 8/1972 | Cooper | 52/286 |
| 3,691,708 | 9/1972 | Firnkas | 52/259 |
| 3,693,308 | 9/1972 | Trezzini | 52/432 |
| 4,249,354 | 2/1981 | Wynn | 52/439 |

*Primary Examiner*—John E. Murtagh
*Attorney, Agent, or Firm*—Stevens, Davis, Miller & Mosher

[57] ABSTRACT

Some improvements are disclosed in an aseismic building comprised of modular panels anchored in a concrete foundation base by means of vertical rods which are connected with said base and extends along the center of a vertical interpanel duct which is defined between the continuous edges of a pair of panels.

This invention consists mainly of ensuring for said vertical rods, in the related interpannelar duct, a course securedly centered within the same by putting said rod under tension and pouring in the meanwhile a special cement mortar into said duct.

Additional improvements comprise in the use of a plastic profile which is inserted within and along a suitable channel formed between two adjacent panels vertical profiles for ensuring the tightness between said panels. Lastly a movable form is disclosed for making string courses around the building at the height between two successive stories.

2 Claims, 6 Drawing Figures

FIG. 5
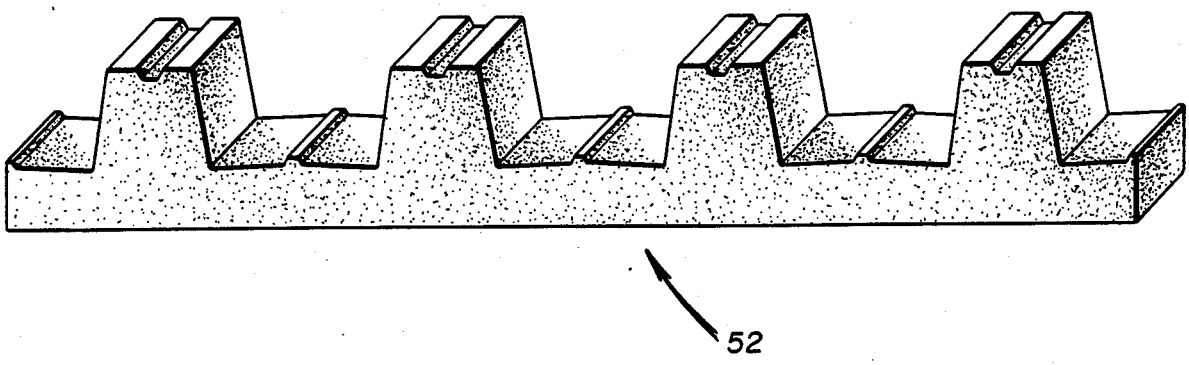
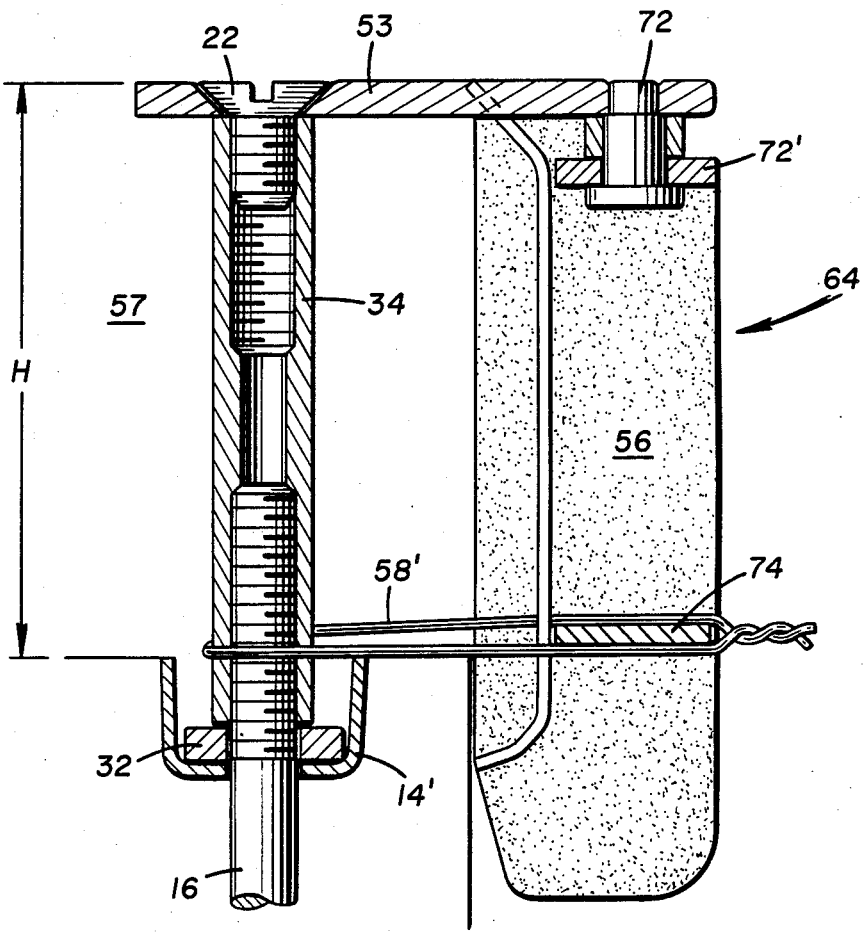
FIG. 6

MULTISTORIED ASEISMIC BUILDING MADE OF MODULAR PANELS

The present invention relates to a multistoried building structure. A multistoried building structure is known having a concrete foundation base and provided with perimetrical and interior walls made of prefabricated reinforced concrete panels in each of which metal upper channellike profiles are embedded and which are connected to one another by means of metal plates which connect the upper profiles of two contiguous panels. The panels are tied to the building foundation base by means of vertical tie rods which are hooked at their lower ends onto an inverted T profile which is embedded in the building foundation slab or base.

The rods extend within and along vertical ducts which are defined between two adjoining panels and specifically between the respective vertical metal channels belonging to the panels. Whenever the building is two-storied then a roof is interposed between two subsequent stories which roof comprises a furrowed sheet—preferably with furrows of trapezoidal cross-section—of which the periferical border rests on the wall by which the room to be covered by said roof is defined, which sheet functions as a cooperating element and as a form for casting a concrete mass and which will be obviously left permanently on the site.

In the practical use of the above structure, some drawbacks has been found either in construction and operation which have been overcome by the following improvements which are deemed patentable.

(1) Panel shapes.

Known panels comprise a "normal" panel which is a rectangular prefabricated concrete panel in which, during the fabrication, the following items are embedded: a double reinforcement comprising two grids parallel to one another and to the panel faces; a channellike profile along the panel side which is the upper side when installed; and two metal channellike profiles along the sides of the panel. The above metal elements are embedded in the panel concrete mass when the panel is cast.

In the known panels each of the panel vertical profiles has a transverse horizontal cross-section comprised of a half-rectangle which, together with the half rectangle of the adjacent panel defines a vertical duct for the passage of a vertical tie rod. From the borders of each of the half rectangles two extensions project first towards the outside of the wall and then slightly towards the inside of the wall where they become embedded. Between a pair of adjacent panels, a space is thus left through which atmospheric water can penetrate from the outside and vice-versa cement mortar can leak from the duct when pouring it into the duct as explained hereinafter. Thus according to the known panels, a wooden or metal rule must by applied to the outside of the interpanellar junction the rule being temporarly applied and later removed.

In order that such drawbacks be overcome according to this invention, the metal lateral profiles of two contiguous panels are made to form between them a channel into which a PVC strip is inserted for the whole panel length.

The PVC strip is readily inserted into the channel and differently from the above rule, must not be removed after the work. It implies therefore a sparing of time. Furthermore because the strip is left in site in prevents any penetration of moisture from outside.

The above variant can be obviously applied in those C or L junctions of the panels.

(2) The jointing together of a pair of adjoining panels.

According to known panels, for mechanical reasons, due to the presence of the lower end hook of the tie rod, has the tie rod run along the duct between the panels within one half of the duct cross-section: More than that due to the presence of the concrete mortar it may result in it being far from rectilinear. This obviously reduces the bending strength of the complex: that is the vertical tie rod and the side profiles of the adjacent panels by which the rod is surrounded. This did not appear to be rational in as much as the bending stress acting on the building, particularly in earthquakes, is not well known. In any case the bending strength of the complex should be kept constant along the same and therefore the tie rod has to be made rectilinear and kept under tension and placed to run along the center line of the duct.

In addition to the above, the means for hooking the tie rod onto the inverted T iron was cumbersome, time consuming and prejudicial to the tie rod linearity.

In U.S. Ser. No. 810,592, filed Dec. 19, 1985, the tie rod lower length was separated from the rest of the tie rod and buried into the building concrete foundation base. So that the rest of the rod remaines rectilinear and is readily screwed on the lower sunken section. While the rectilinear section of the rod according to the cited application extends upwards, it then passes through one of the plates by which a pair of upper profiles of a pair of adjoining panels are provided. Now, by the use of the rod passage through the connecting plate of two adjoining panels, which passage is amply larger then the rod, the cement mortar is poured into said duct and subsequently a nut is fitted on the top end of the rod which nut rests on a washer much larger than the rod diameter. It is obvious that during the pouring of the motor the tie rod is subjected to random bendings whereby the bending strength at the different heights of said complex is varied. For overcoming the above drawbacks and according to the present invention it has been found useful to apply a traction on the tie rod during the mortar pouring into said duct. To this purpose an angle hole was provided in the jointing plate which will be called first plate which serves for connecting the pair of panels upper profiles and a second plate was made to overlap said hole which said second plate in addition to a bore for passing the tie rod theretrough has a second hole for pouring the cement mortar therethroug.

(3) Removable mold for forming a stringcourse around each building floor.

At the upper level of the wall comprised of the panels a floor is provided which may be a cover-floor or an inter-story floor. For building such a floor, a special mold is used which is removably mounted all around the building at the height of the floor to be built. Such mold is temporarily affixed to each tie-rod of the building and keeps the mold properly propelled against the wall of the building which extends below the floor.

The building improvements as outlined above will become more apparent from the following description and from the annexed drawings which illustrate, by way of example a preferred embodiment thereof.

FIG. 5 a perspective view of a polyurethane packing strip for preventing any cement mortar for falling down from a buidling floor;

FIG. 6 shows a schematic view of a removable mold for forming a string course around a building floor.

Figure 1:
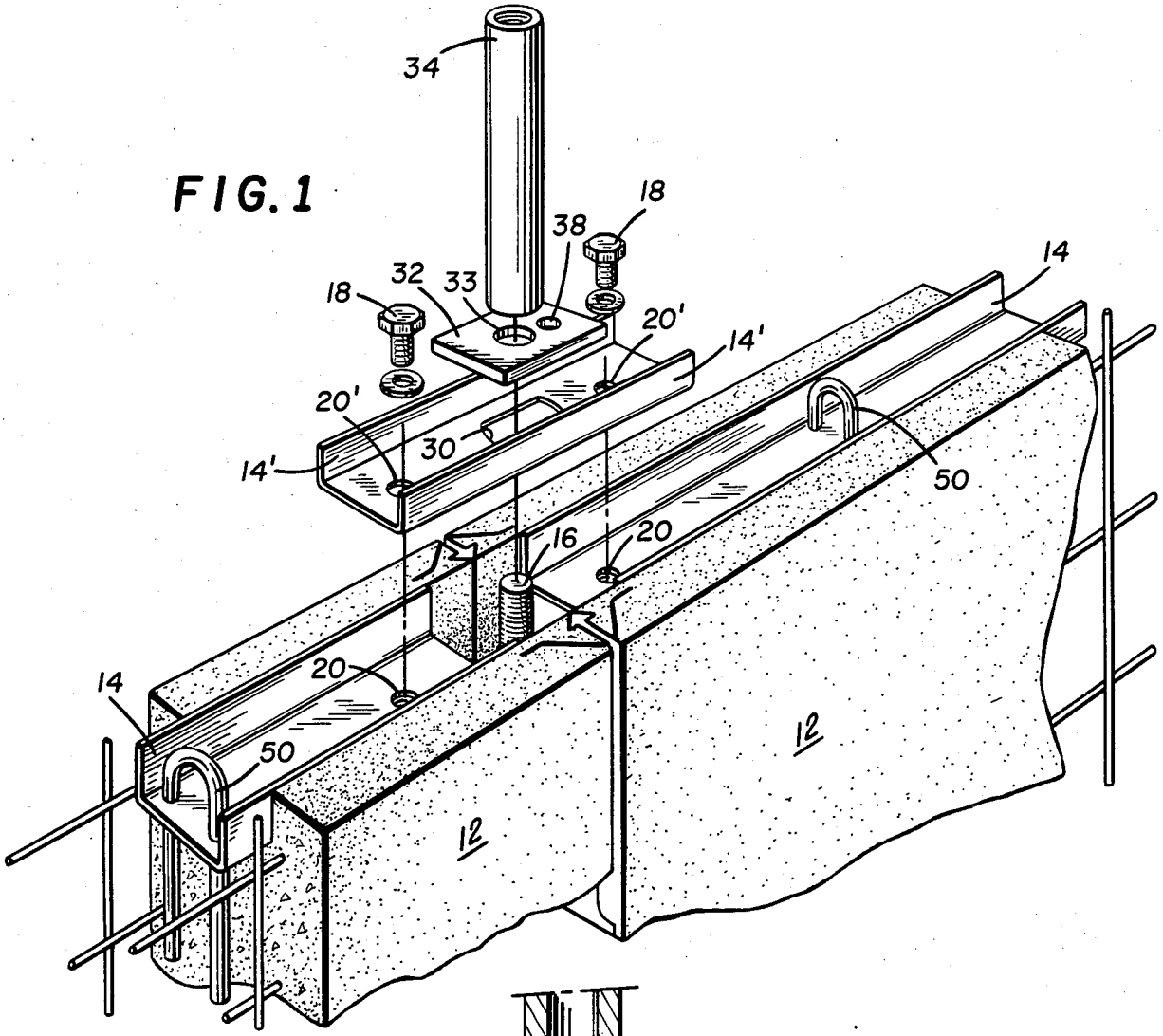
FIG. 1 shows an exploded view of the upper connection between a pair of adjacent panels and of the hooks for lifting the panels.
Figure 2:
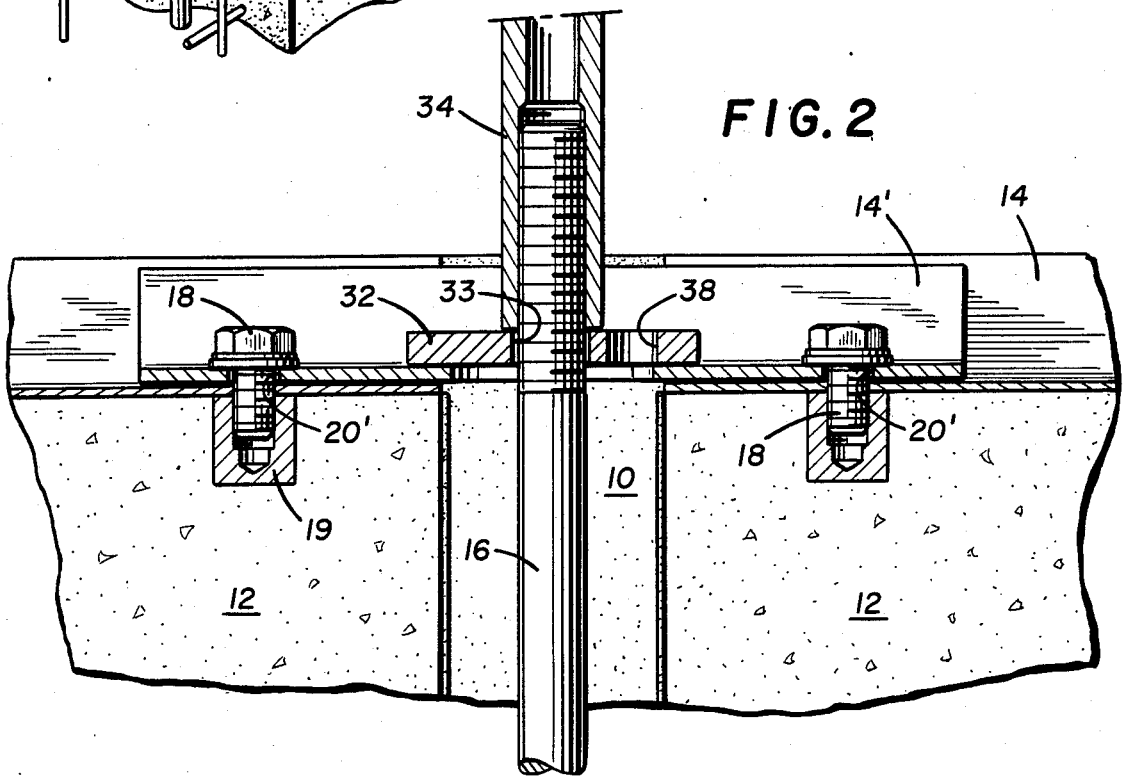
FIG. 2 shows a schematic view of the connection between two adjoining panels and of the continuation of an interpanellar tie rod to an upper building storey.
Figure 4:
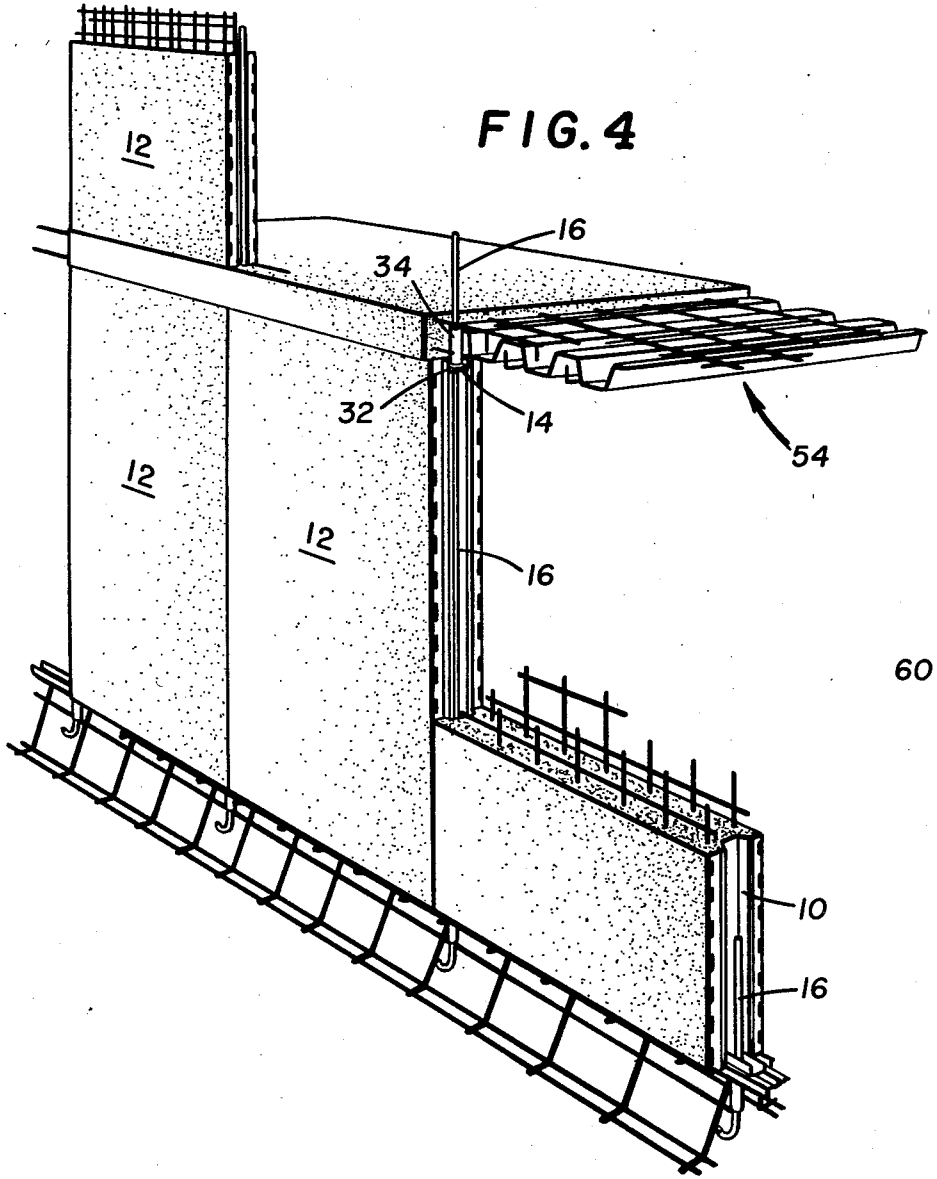
FIG. 4 shows a perspective view of a building being erected according to the invention.

With reference to FIGS. 1, 2 and 4 a pair of panels are illustrated between which a vertical duct 10 runs. Panels 12 are provided each with an upper profile 14 and are jointed together by a panel connection profile 14' which extends symmetrically, with respect to duct 10, along the upper profile 14' of each panel for a certain distance from tie rod 16. The connection of the pair of panels to one another is made by bolts 18 which pass through bore 20' of profile 14; which bolts; penetrate the mass of each panel and each screws into box nut 19 provided in each panel.

In a position half way from bolts 18 in profile 14', and, which is more important, in a position superposed to the vertical tie rod 16 duct a window 30 is provided which window is centered about tie rod 16 projecting upwards from the underlying interpannelar duct. Above window 30 a plate 32 is provided which covers 30 window. Plate 32 has hole 33 at the center thereof through which a threaded length of tie rod 16 is led. Tie rod 16 after fitting plate 30 thereover, screws into a short threaded tube 34 within which it stops at a short distance above panel 12, the purpose of tube 34 being to apply a positive traction to tie rod 16 and for threadingly engaging it to the tie rod section of the overlying tie rod section.

In FIG. 1 are clearly shown the pair of U-shaped irons 50 which serve for lifting each panel 12 and for concurring in the supporting the same panel shear.

With reference to FIG. 5 and point 3 as above, a polyurethane packing strip 52 is illustrated therein for preventing any concrete mortar from falling down when such mortar is poured for forming a building floor.

According to known flooring, a floor is made at the upper level of a building wall which floor comprises a furrowed sheet 54 which extends from one to another of the inner borders of the respective metal upper profiles of two adjoining panels. Both the downwards facing furrows of said sheet are closed by metal plates for preventing the concrete mortar when laid on the sheet from falling down.

According to this patent application a polyurethane strip is provided as a closure for the downward furrows both for sparing labor and for making a more sure positioning of the sheet furrows closure. The upwardly facing profile of such leakproofing strip exactly fits into the downward facing profile of said furrowed sheet.

Strip 52 is made of poly urethane and is glued along the inner corner formed by the furrowed sheet 54 and the upper edge of panels 12 of a building wall.

With reference to FIG. 6, a special moulding fixture 64 is illustrated therein for making a string-course all around a building floor which may be between two stories or over the building according to the invention.

The removable molding fixture of this invention comprises a cramp 64 which is fastened to each of tie rods 16 of the building and has a plan width equal about to the width of the interpanellar width of the wall and by a molding sheet 56 which extends for all the required wall length. The profile of the molding sheet 62 is chosen at will.

In FIG. 6 tie rod 16 extends vertically from the lowermost foot of the wall or from an underlying story. As already mentioned, tie rod 16 penetrates the short tube 34 which extends for all the floor height (H). At about one half of tube 34 it stops and, after a short interruption, a threading that had begun at the lower end of tube 34 begins again for receiving a flat machine screw 22. Screw 22 will be removed before the lower end of a further tie rod 16 is threaded into tube 34 for extending the building for a further story. A plate 53 is fastened to tube 34 by screw 22, which plate is placed at the level of the intended floor 57 upper surface.

A vertical element 56 of the fixture extends down from plate 53. The molding sheet 56' is held by element 56 with the aid of a vertical pin 72 and a prop 72' against the surface to be provided with stringcourse. To the same purpose a rope 58' is also provided, which ties rod 16 to element 56 and which will be later cut at the end of the stringcoursing. Said vertical element being also provided with a horizontal strip 74 for bonding said rope.

Summing up, vertical element 56 is anchored at top to the flat machine screw and at the bottom to tube 34 by means of wire 58'.

The operation of fixture 64 is as follows: After the laying of the furrowed sheet the whole building will be totally or partially encircled with the above fixture for forming a stringcourse and a layer of concrete will be laid enough thick on said furrowed sheet for reaching at the upper level of said floor. At the end of the cement setting flat machine screw 22 is removed and rope 58 will be cut and subsequently the fixture will be removed.

Figure 3:
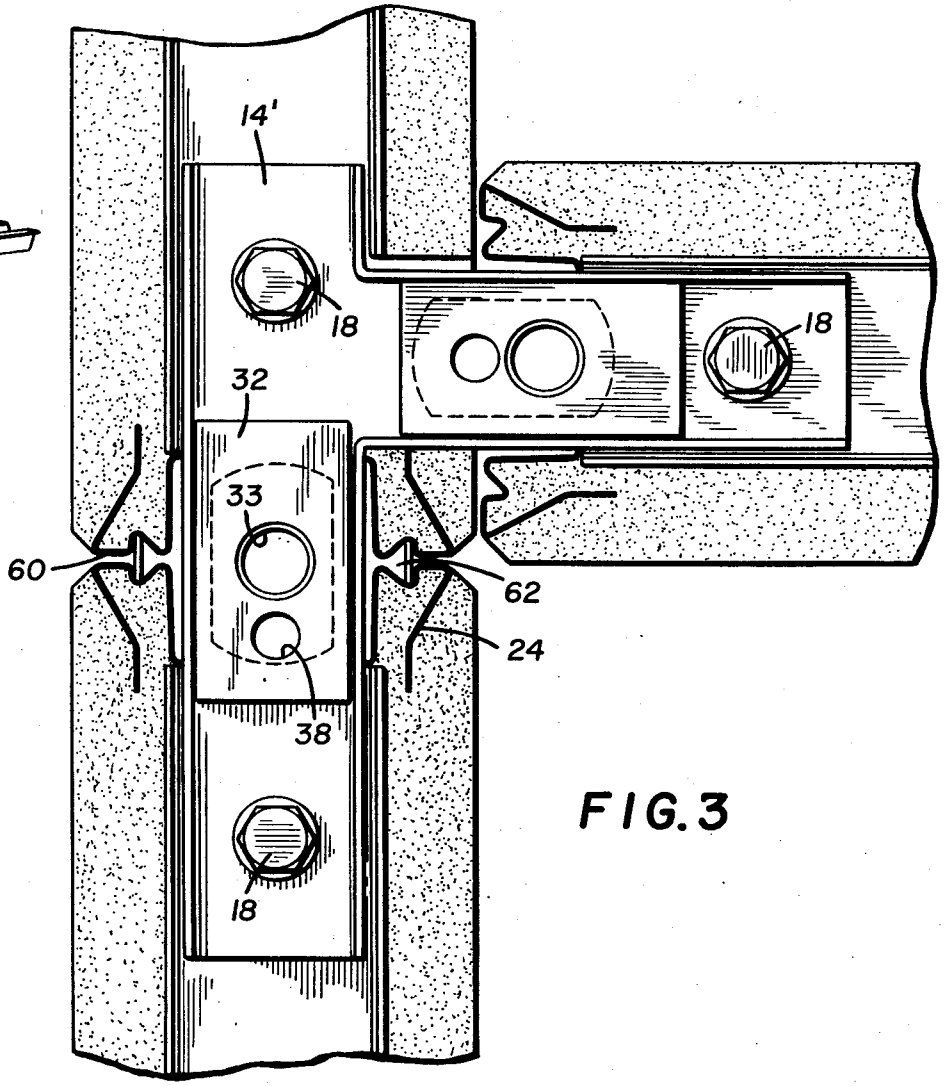
FIG. 3 shows schematically a joint of an interior wall panel and the related PVC leak proofing strip.

A further improvement has been already expressed in point 1. It is illustrated in FIG. 3 as PVC strip 60 which is inserted for all the length of a panel into a channel 62 as formed by the side profiles 24 of a pair of adjacent panels.

What is claimed is:

1. An aseismic multistoried building comprising: modular perimetral and interior wall panels, a concrete foundation base and at least one sheet trapezoidal furrowed floor on which a concrete slab extends, a metal profile positioned along each vertical side of a panel and imbedded into said panel; adjoining panels defining therebetween an interpanellar duct having a nearly square horizontal cross section; a threaded tie rod passing along said duct for anchoring a pair of panels to said foundation base; a metal profile positioned at the top of each of said panels and embedded into said panels; a short channel inserted into the top profiles of adjoining panels and extending horizontally across said duct; means anchoring said top profiles and short channel to each said adjoining panel; said short channel defining a central window; a plate positioned on said short channel overlapping said window; said plate defining a first hole at its center through which the tie rod passes and a second hole offset from said first hole for pouring cement mortar therethrough and into said duct; and a short threaded tube screwed onto the end of said tie rod for possible connection with a further tie rod.

2. The building as claimed in claim 1 including a leak proofing strip positioned along the inner upper corner between said furrowed sheet and the tops of said walls, said leakproofing strip being fastened to the building wall and to the downward face of said sheet and having a series of upwardly projecting extensions which fit into the lower profile of said sheet for a short terminal length of them.

* * * * *